US010076779B2

(12) United States Patent
Jaubert et al.

(10) Patent No.: US 10,076,779 B2
(45) Date of Patent: Sep. 18, 2018

(54) DEVICE FOR BENDING PROFILE SECTIONS SUCH AS TUBES

(71) Applicant: ADMC HOLDING, LLC, Lebanon, OH (US)

(72) Inventors: Philippe Jaubert, Cologne (FR); Jean Paul Chastan, Taulignan (FR)

(73) Assignee: ADMC HOLDING, LLC, Lebanon, OH (US)

( * ) Notice: Subject to any disclaimer, the term of this patent is extended or adjusted under 35 U.S.C. 154(b) by 400 days.

(21) Appl. No.: 14/768,208

(22) PCT Filed: Jan. 20, 2014

(86) PCT No.: PCT/FR2014/000012
§ 371 (c)(1),
(2) Date: Aug. 14, 2015

(87) PCT Pub. No.: WO2014/111638
PCT Pub. Date: Jul. 24, 2014

(65) Prior Publication Data

US 2016/0023259 A1 Jan. 28, 2016

(30) Foreign Application Priority Data

Jan. 21, 2013 (FR) ..... 13 00124

(51) Int. Cl.
*B21D 7/024* (2006.01)
*B21D 7/02* (2006.01)

(52) U.S. Cl.
CPC ..... *B21D 7/021* (2013.01); *B21D 7/024* (2013.01)

(58) Field of Classification Search
CPC ..... B26D 3/16; B26D 2007/013; B26D 7/02; B26D 2001/0066; B23D 21/00;
(Continued)

(56) References Cited

U.S. PATENT DOCUMENTS 7,159,430 B2 * 1/2007 Yogo ..... B21D 7/024 72/129
7,254,972 B1 * 8/2007 Wang ..... B21D 7/021 72/149
7,360,385 B1 4/2008 Wohlenhaus et al.

FOREIGN PATENT DOCUMENTS

EP 1459816 A1 9/2004
EP 1914021 A1 4/2008
(Continued)

OTHER PUBLICATIONS

International Search Report for PCT/FR2014/000012, dated Mar. 25, 2014.

*Primary Examiner* — Peter DungBa Vo
*Assistant Examiner* — John S Lowe
(74) *Attorney, Agent, or Firm* — Welsh Flaxman & Gitler LLC

(57) ABSTRACT

The invention relates to a device for bending profile sections, comprising at least one bending form (36) centered on a bending axis, provided with a peripheral groove that is interrupted by a cutout, a stack of clamping jaw counterparts (42-45) each comprising a cavity for clamping the profile section and having a shape designed to fit into the cutout of each bending form (36) with the cavity extending in the continuity of the peripheral groove of said bending form, means (51-53) for the so-called vertical movement of the stack of clamping jaw counterparts (42-45) which means are designed to move said stack along an axis parallel to the bending axis, a stack of clamping jaws (55-58), comprising cavities that complement the cavities of the clamping jaw counterparts (42-45), and means (70, 72-74, 76, 80, 81) for the relative movement of the assembly made up of the bending form(s) (36), the stack of clamping jaw counterparts (42-45) and the stack of clamping jaws (55-58).

15 Claims, 10 Drawing Sheets

(58) Field of Classification Search
CPC ..... B21D 7/024; B21D 7/021; B21D 37/14; B21D 7/12; B21D 43/003; B21D 43/105; B23Q 3/15573
See application file for complete search history.

(56) References Cited

FOREIGN PATENT DOCUMENTS

| | | | |
|---|---|---|---|
| EP | 2163323 | A2 | 3/2010 |
| WO | 0016922 | A1 | 3/2000 |

* cited by examiner

DEVICE FOR BENDING PROFILE SECTIONS SUCH AS TUBES

The invention concerns a device for bending profiled parts such as pipes, and in particular a device allowing the bending of pipes in order to produce exhaust lines and manifolds in the automotive field.

The exhaust lines and manifolds of automobiles have the peculiarity of often having between two bent pieces a straight piece of insufficient length to ensure the clamping of the pipe during the bending process. Therefore, the bending machines used to produce these pieces need to be outfitted with a plurality of pairs of clamping jaws making possible a clamping of the usual straight pieces but also the clamping of bent pieces with various angles and orientations.

Figure 9:
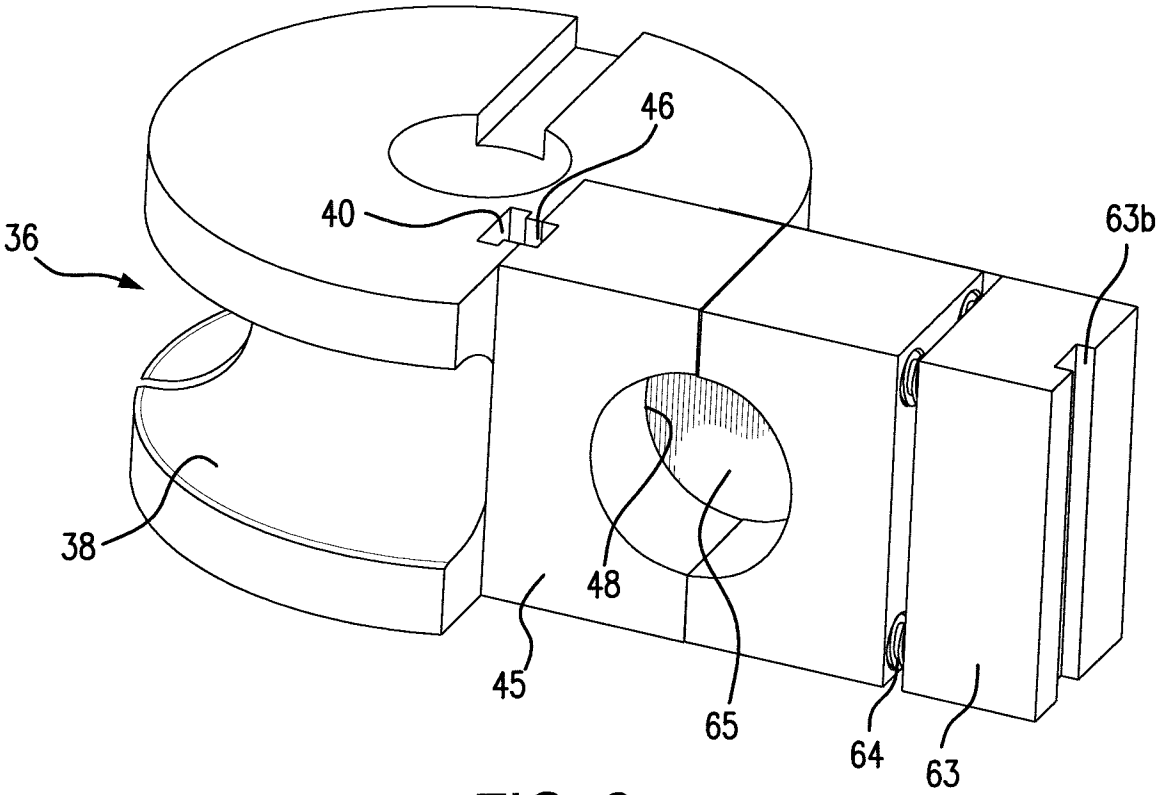

At present, the classical bending machines used for this purpose include primarily the one described in particular in the patents FR2530980, U.S. Pat. No. 7,254,972, U.S. Pat. No. 7,360,385, and EP1459816:

- a frame on which are positioned means of displacement of a pipe along a longitudinal axis (x),
- a bending head comprising, as shown in FIG. 9 of FR2530980, a plurality of overlaid bending formers oriented to a bending axis and each one comprising a specific clamping cavity, straight or bent, overlaid clamping jaws in a number equal to the number of bending formers, each one having a cavity complementary to that of one of said bending formers, and means of relative displacement of said bending formers and clamping jaws,
- and means of relative displacement of the frame and the bending head adapted to position in the same plane the pair of bending former and clamping jaw selected and the axis of displacement.

A first drawback of these bending machines resides in the fact that they require a number of bending formers equal to the number of cavities required, as well as a corresponding wiper die and guide bar for each of these bending formers.

Moreover, in order to change the bending formers, it is necessary to move either the frame or the bending head, which are heavy and bulky parts whose movement, on the one hand, requires motorized equipment, and on the other hand they are relatively slow, given the inertia of these parts in particular, and this slowness results in relatively long cycle times which have an negative impact on the productivity of these bending machines.

What is more, the axis of the bending formers of these bending machines is subjected to torsional forces which are all the larger as the bending former used is further from the anchoring point of this axis, and in practice such forces require making this axis more rigid with the help of reinforcement elements known as "braces".

However, due to their positioning, these braces prove to be an obstacle in the manipulation of the pipes and result in longer cycle times.

Some of these drawbacks have been solved by the bending machines which are described in particular in the patent applications WO 99/38626 and WO 00/16922 which basically comprise:

- a bending former oriented on a bending axis (Z) orthogonal to the longitudinal axis of the profiled section, having a peripheral groove interrupted by an indentation made in said bending former,
- a plurality of pairs of clamping jaws, each one composed of:

- a clamping jaw with a shape adapted to fit into the indentation of each bending former with its cavity extending as a continuation of the peripheral groove of said bending former,
- a complementary clamping jaw adapted to be mounted on a support which is movable relative to the bending former, carried by an arm which can rotate about the bending axis, means of displacement of the pivoting lever or barrel type disposed to simultaneously move the two clamping jaws of each pair of clamping jaws between a passive storage position and an active bending position and means of driving the rotation of the bending former and the rotary arm.

According to this principle, the bending machine comprises, for the same radius of bending, a single bending former, and thus a single bar and a single wiper die, which are associated with a plurality of pairs of clamping jaws having different clamping cavities.

What is more, the parts to be moved during the bending operations have a relatively low weight and volume and their movement requires motorized equipment of relatively modest power.

On the other hand, the operations of grabbing and transfer of each pair of clamping jaws prove to result in relatively long cycle times which have a negative impact on the productivity of these bending machines.

Furthermore, these transfers require transfer means which are relatively large and costly which, given their positioning above the bending machine, proves to be an obstacle making it harder to manipulate the pipes.

The present invention intends to mitigate these drawbacks and its main purpose is to provide a bending machine having a single bending former for each radius of bending, and whose cycle times are reduced in optimal manner.

Another purpose of the invention is to provide a bending machine with no obstacles liable to prevent the manipulating of the pipes.

Another purpose of the invention is to provide a bending machine able to integrate a cutting station (cutting blade, punch, etc.) at less cost.

Another purpose of the invention is to provide a bending machine designed such that the upstream section of the bending former is totally free and clear.

Toward this end, the invention involves a device for the bending of profiled sections (T) such as pipes, extending along a longitudinal axis (X), comprising in combination:

- at least one bending former oriented along a bending axis (Z) orthogonal to the longitudinal axis (X), having a peripheral groove interrupted by an indentation devised in said bending former,
- at least two clamping jaws, so-called counter clamping jaws, stacked one upon the other, each one comprising a clamping cavity for the profiled section (T), and having a shape disposed to fit into the indentation of each bending former with their cavity extending as a continuation of the peripheral groove of said bending former,
- means of vertical displacement of the stack of counter clamping jaws, disposed to move said stack along an axis parallel to the bending axis (Z) in order to allow a positioning of each counter clamping jaw in the indentation of a bending former,
- at least two clamping jaws stacked one upon the other, comprising cavities which are complementary to the cavities of the counter clamping jaws, means of relative displacement of the assembly formed by the bending former(s) and the stack of counter clamping jaws and the stack of clamping jaws between a closed position of mating of one clamping jaw with the counter clamping jaw positioned in the indentation of a bending former and an open position of separation of the stack of counter clamping jaws and the stack of clamping jaws, and means of driving in simultaneous rotation about the bending axis (Z) each bending former, the stack of counter clamping jaws and the stack of clamping jaws.

In the first place, like the one described in the patent applications WO 99/38626 and WO 00/16922, the bending machine according to the invention comprises, for the same bending radius, a single bending former, and thus a single bar and a single wiper die, which are associated with a plurality of pairs of counter clamping jaws and clamping jaws having different clamping cavities.

However, according to the invention, the operation of the counter clamping jaws and the clamping jaws making up the stacks differs totally from that described in these patent applications, and results in a totally different kinetics of displacement of the latter. In fact, according to the invention, a changing of cavity simply requires moving the stack of counter jaws along an axis parallel to the bending axis, and adjusting the relative displacement means of the assembly formed by bending former(s), stack of counter clamping jaws and stack of clamping jaws in order to produce a mating between the new counter jaw positioned in the indentation of the bending former and its complementary clamping jaw.

In practice, the time to change the cavity is thus equal to the time needed for the displacement of the stack of counter clamping jaws, which proves to be very short, due to the slight distance traveled and the low weight and volume of the unit being moved.

As for the other bending steps, these require a time equal to that taken by the bending machines described in the patent applications WO 99/38626 and WO 00/16922, so that the overall cycle time according to the invention is reduced in optimized manner.

Furthermore, according to the invention, the distance between the bending former and the anchoring point of the latter is fixed and reduced in optimal manner, so that the achievement of a satisfactory rigidity does not require any reinforcement liable to obstruct the manipulating of the pipes.

Furthermore, since the bending device according to the invention is by its design clear of any other obstacle, the various manipulations of the pipes can be performed in complete freedom.

According to one advantageous embodiment of the invention, the means of relative displacement of the assembly formed by bending former(s), stack of counter clamping jaws and stack of clamping jaws consist in means of displacement of the stack of clamping jaws.

Moreover, these means of displacement of the stack of clamping jaws advantageously comprise according to the invention:

means of transverse displacement of the stack of clamping jaws along a transverse axis (y) orthogonal to the axes (X) and (Z), and means of vertical displacement of the stack of clamping jaws along an axis parallel to the bending axis (Z).

Moreover, according to the invention, the means of transverse displacement and the means of vertical displacement of the stack of clamping jaws are advantageously actuated by means of correlated-control motors, so as to reduce the displacement time of said clamping jaws, and thus reduce the cycle times.

According to another embodiment of the invention, the clamping jaw positioned in the area of the base of the stack of clamping jaws consists of a blank holder designed to be mated with a blank consisting of the counter clamping jaw positioned in the area of the top of the stack of counter clamping jaws, said blank holder being pierced by a transverse seat emerging into the cavity of this blank, accommodating a cutting element associated with elastic means designed to:

hold this cutting element in a retracted position with respect to the cavity of the blank holder in the absence of a force exerted on said elastic means, enable, when a force is exerted on said elastic means in the mated position of the blank holder and the blank, the displacement of the cutting element to an active cutting position in which it extends into the volume bounded by the respective cavities of said blank holder and said blank.

Thus, the bending device according to the invention can be equipped, at low cost, with a cutting station comprising, for example, a punch or a cutting blade whose operating kinetics is identical to that of bending operations.

According to one advantageous embodiment involving this cutting station the elastic means extend between the blank holder and the means of displacement of the stack of clamping jaws, and the means of transverse displacement of the stack of clamping jaws are designed to compress the elastic means in the mated position of the blank holder and the blank. The actuation of the cutting element is thus obtained automatically by ordering the continuation, for a short distance, of the movement of the transverse displacement means of the stack of clamping jaws once mating of the blank holder and the blank has occurred.

Moreover, according to another advantageous embodiment of the invention, each bending former is integrated with one of the ends of a mast centered on the bending axis (Z), along which there extend guiding means for the stack of counter clamping jaws, and on which is integrated a transverse arm along which there extend guiding means for the stack of clamping jaws, said mast being integrated on a plate mounted on means of driving said plate in rotation about the bending axis (Z).

This embodiment totally frees up the space situated upstream from the bending former, so that no length of straight pipe is required upstream from this bending former to produce the next bending; thus, this arrangement helps to augment the potential performance of the bending device according to the invention.

Figure 1:
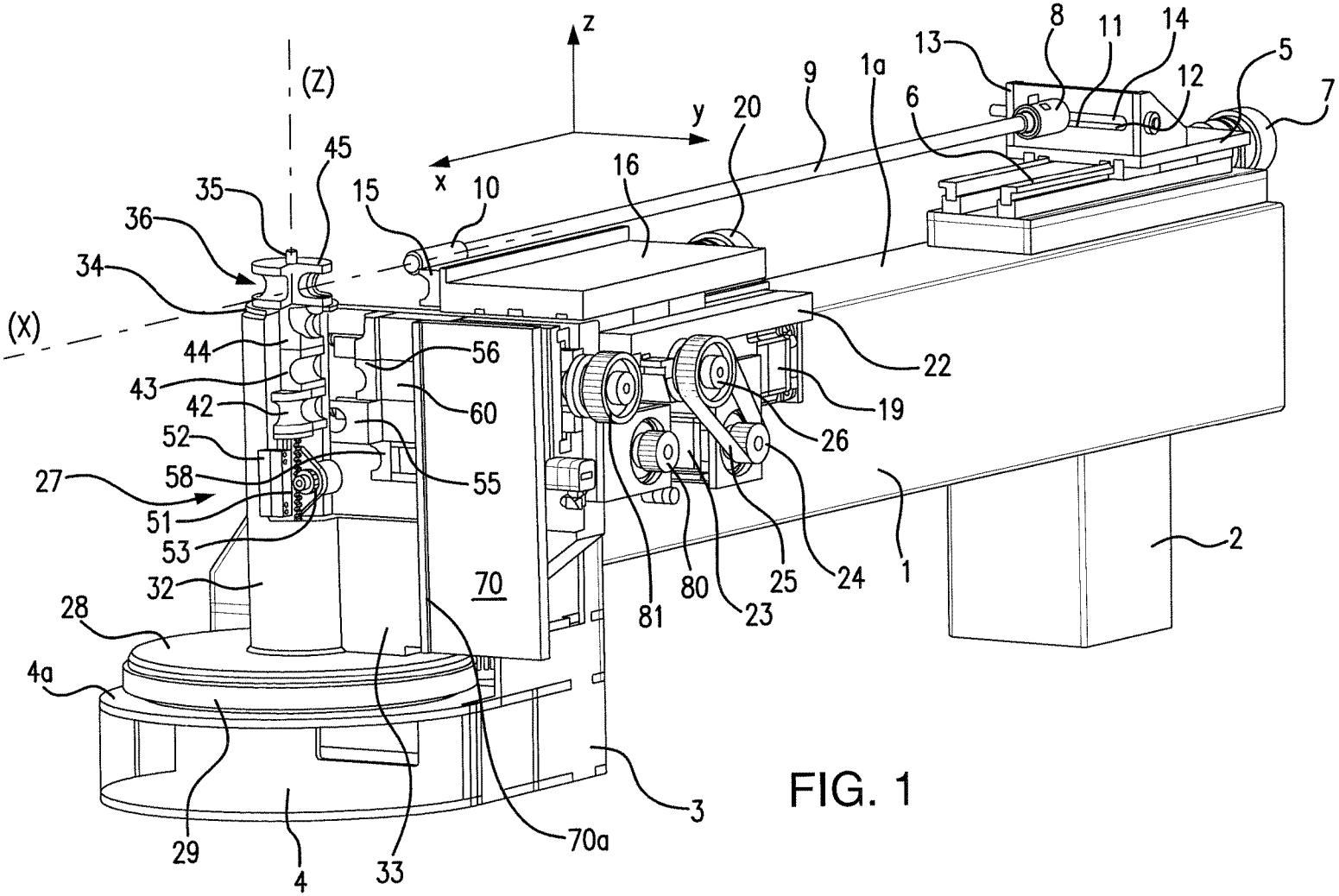
Figure 2:
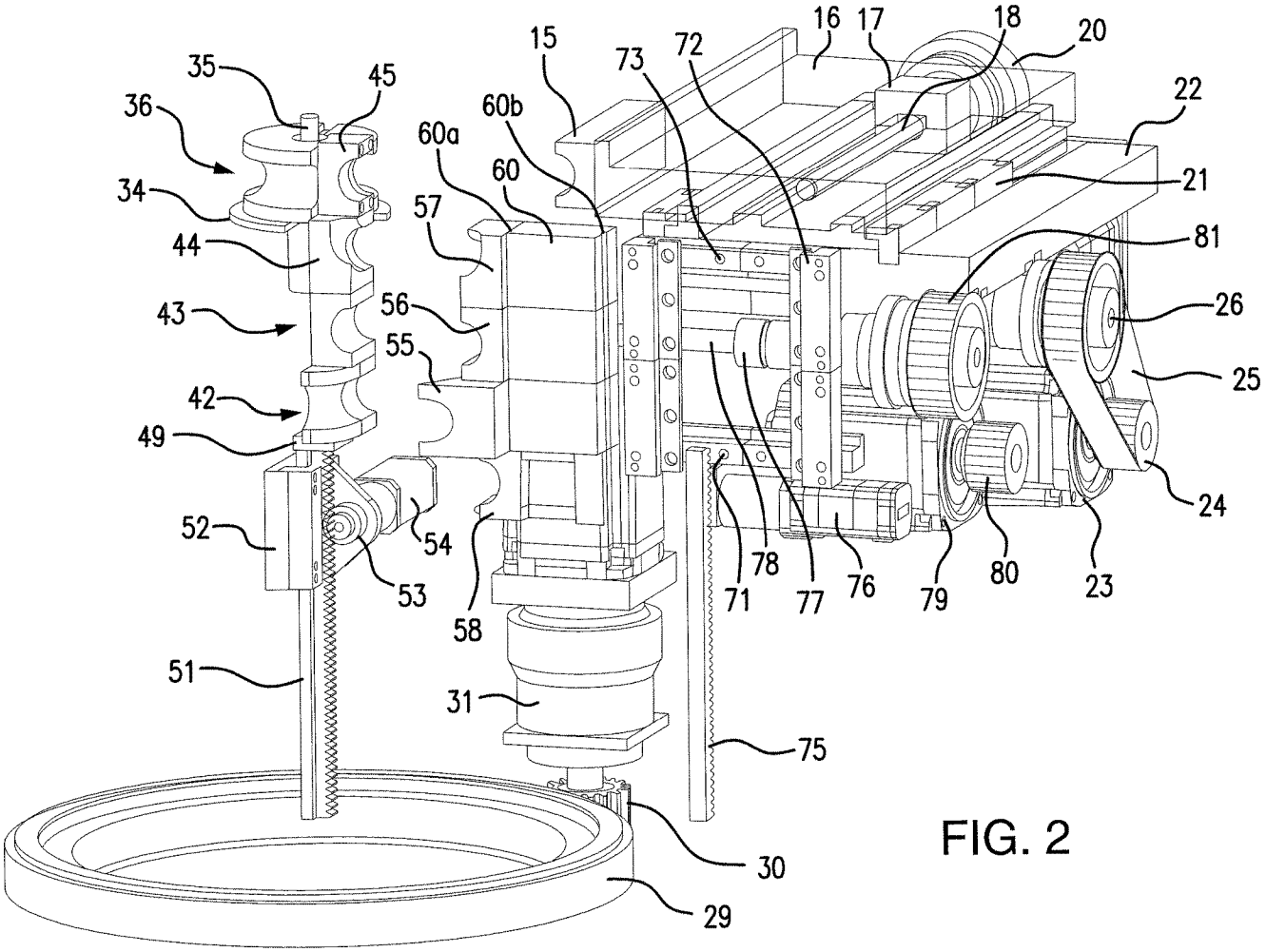
Figure 3:
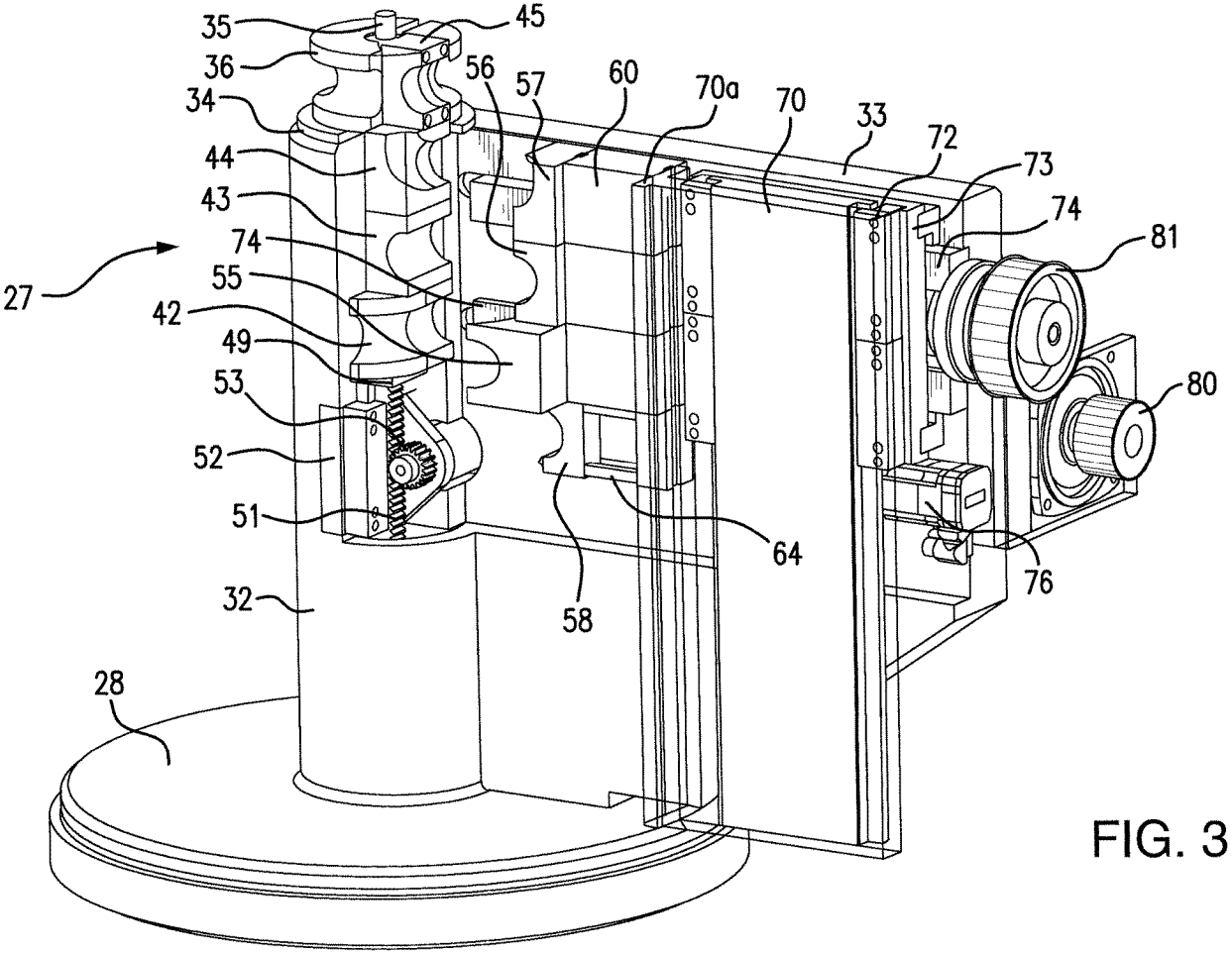
Figure 4:
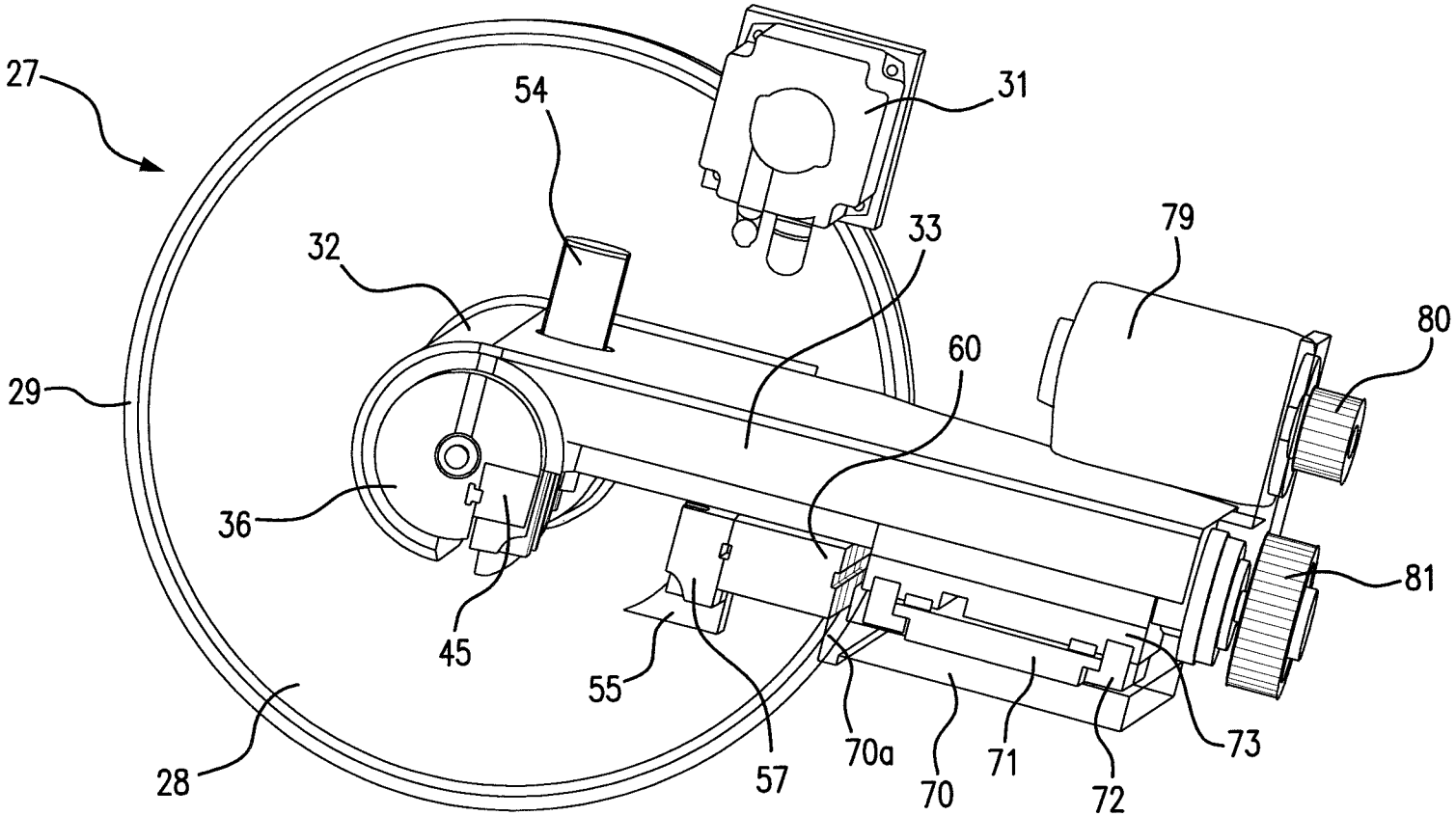
Figure 5:
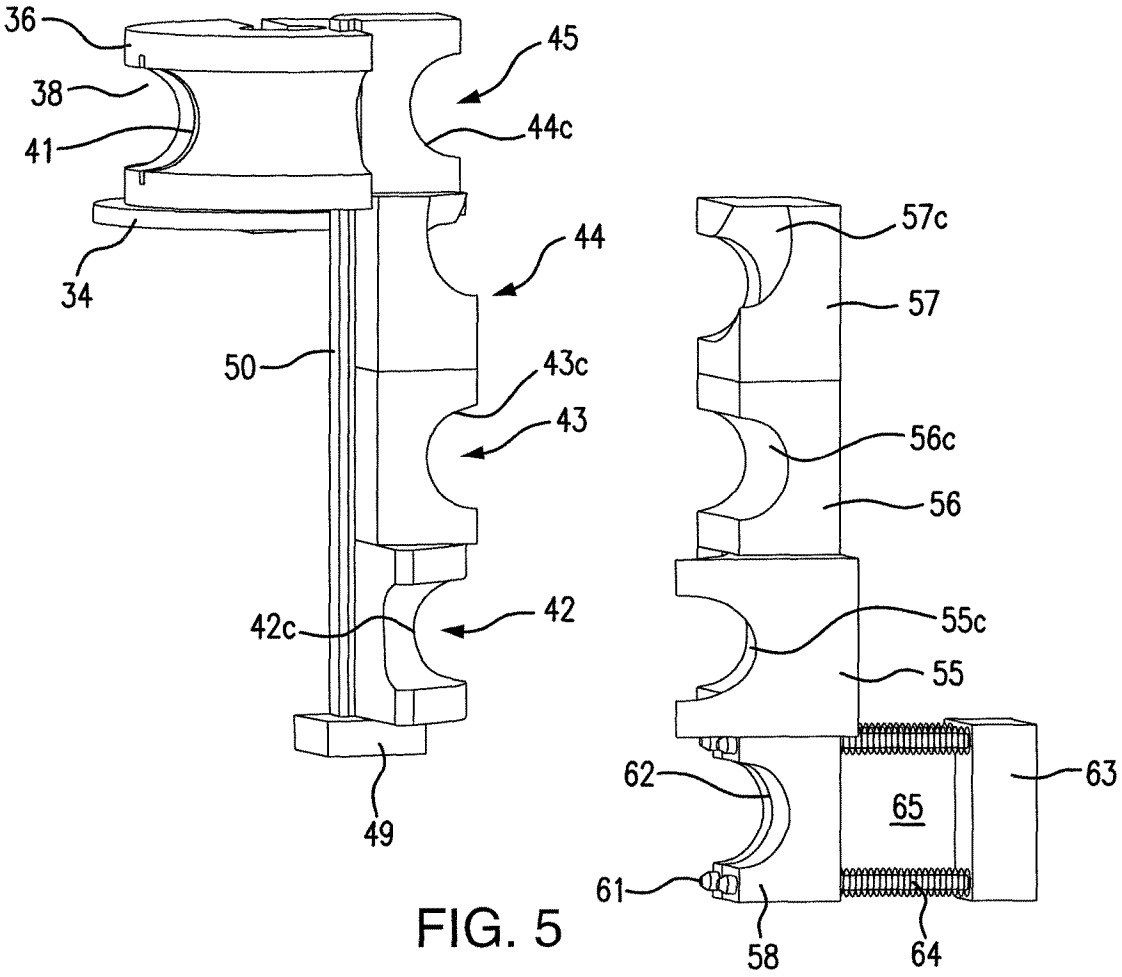
Figure 6:
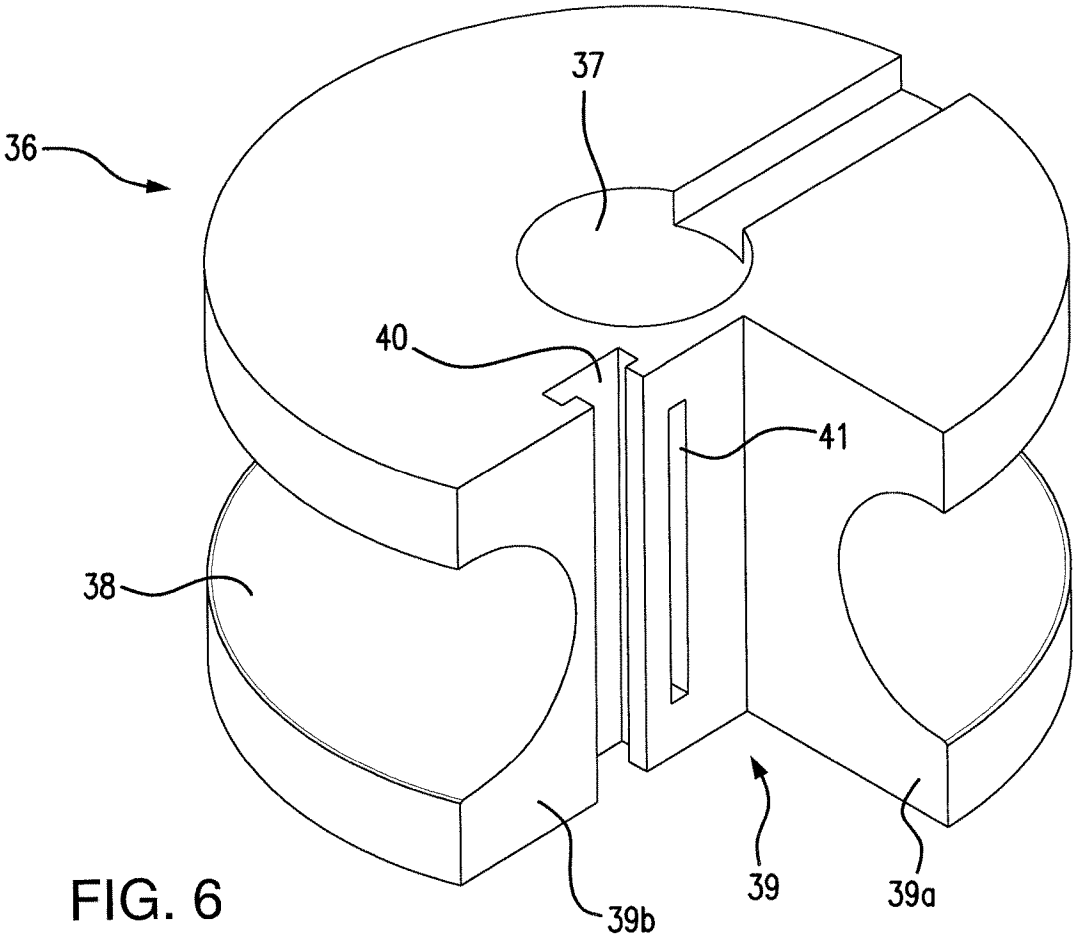
Figure 7:
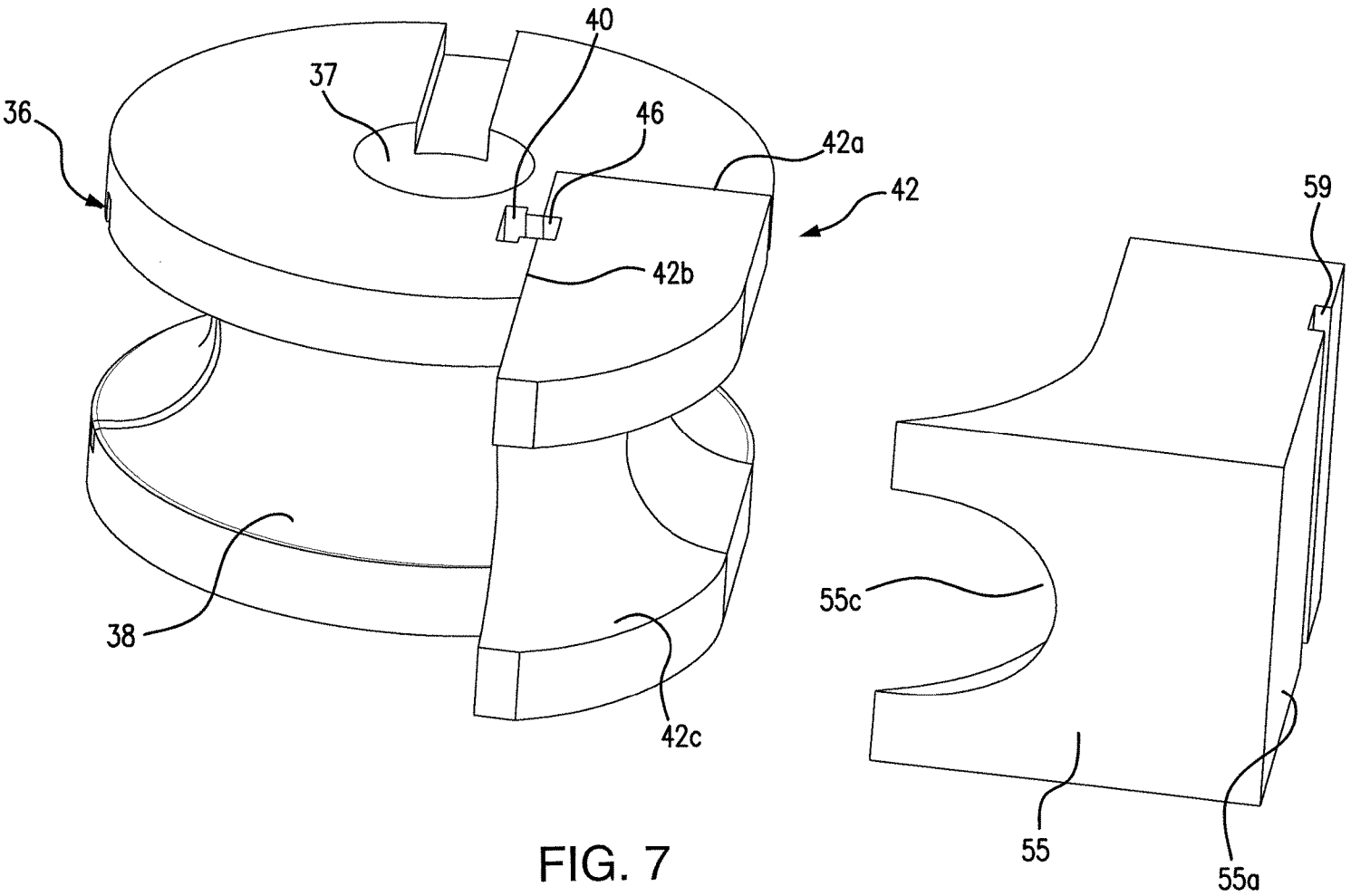
Figure 8:
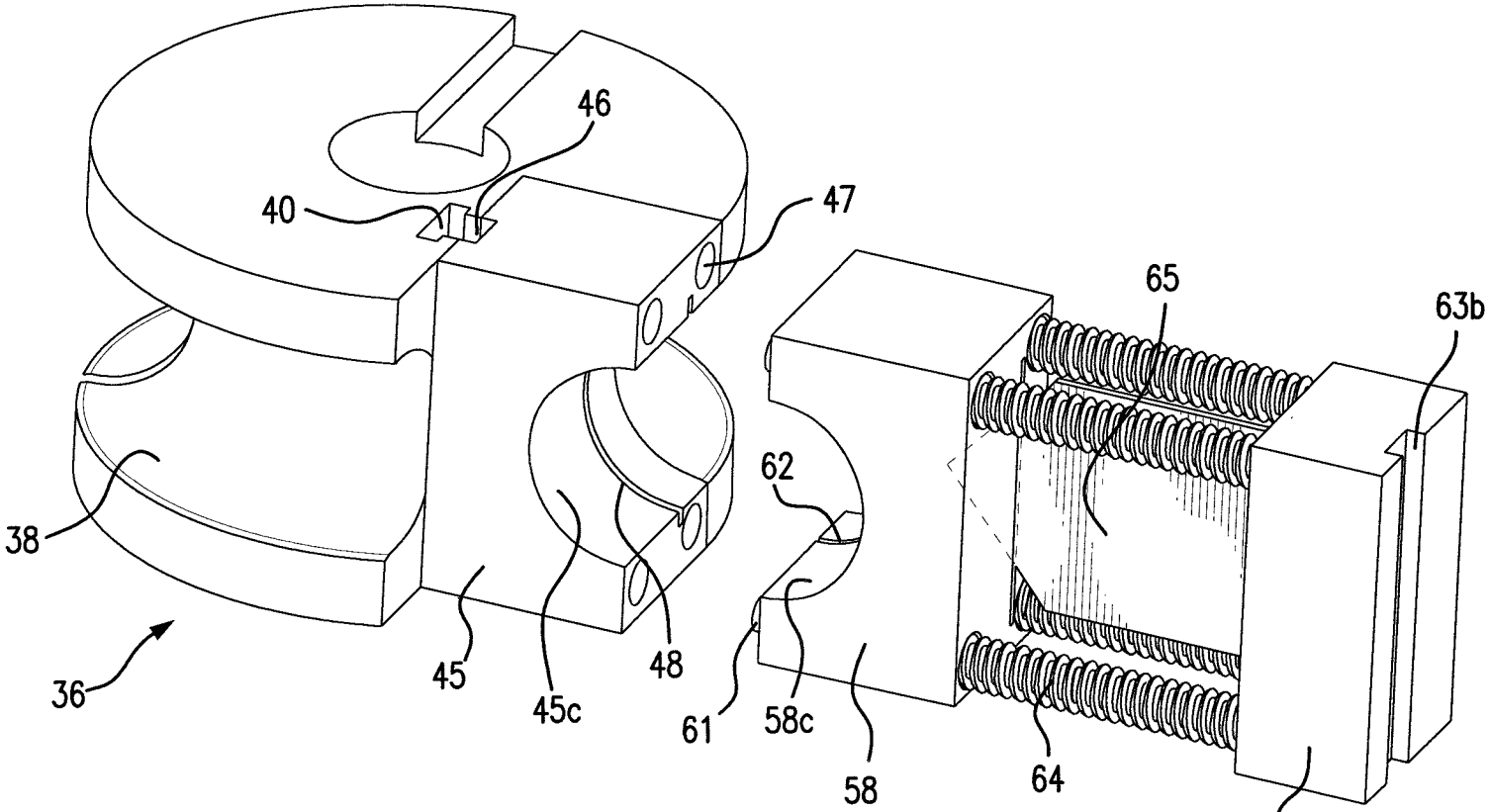
Figure 10A:
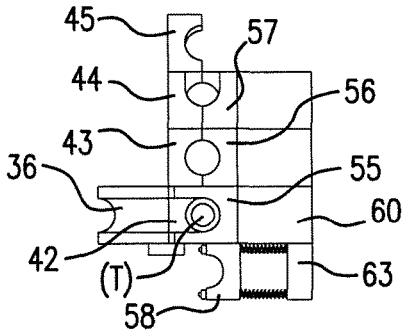
Figure 10D:
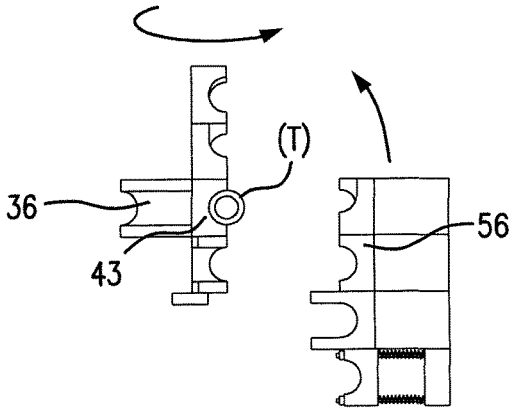
Figure 10B:
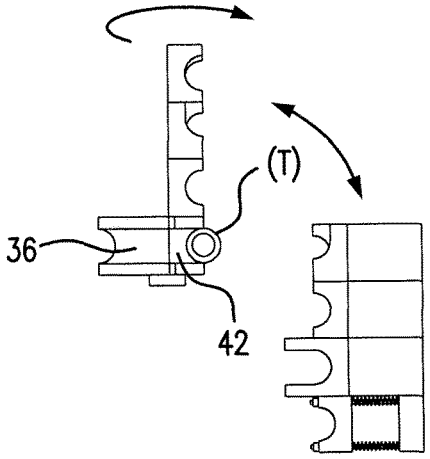
Figure 10E:
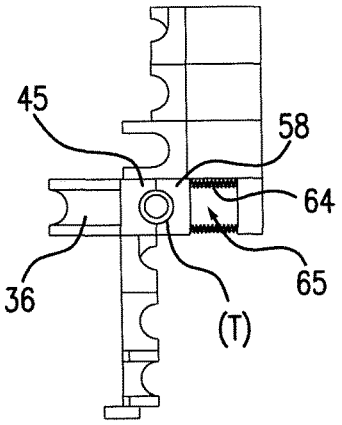

Other characteristics, purposes and advantages of the invention shall emerge from the following detailed description made in reference to the enclosed drawings which show as a nonlimiting example one preferred embodiment. In these drawings:

FIG. 1 is a schematic perspective view of a bending device according to the invention, FIG. 2 is a perspective view, with partial removals, of the bending head of this bending device, FIG. 3 is a perspective view of the rotary mast and the rotary arm of this bending head, FIG. 4 is a top view of this rotary mast and this rotary arm, FIG. 5 is a perspective view of the bending former and the stacks of counter clamping jaws and clamping jaws according to the invention, FIG. 6 is a perspective view of one bending former according to the invention, FIG. 7 is a perspective view of an assembly of bending former/counter clamping jaw and a clamping jaw, in the open position of said counter clamping jaw and clamping jaw, FIG. 8 is a perspective view of an assembly of bending former/blank and a blank holder, in the closed position of said blank holder and blank, FIG. 8 is a perspective view of an assembly of bending former/blank and a blank holder, in the open position of said blank holder and blank, FIGS. 10*a* to 10*d* are diagrams illustrating the stages of a bending cycle with changing of cavity with the aid of a bending device according to the invention, and FIG. 10*e* is a diagram illustrating one of the stages of a cutting operation performed with the aid of a bending device according to the invention.

The bending device according to the invention shown as an example in FIG. 1 consists of a machine for bending a profiled section carried by means of displacement (not shown) suitable for movement along a horizontal displacement axis (X), and comprising for example either a gripper associated with means of driving the latter along the longitudinal axis (X), or a 6-axis robot of the type described in patent FR2914203.

It should be noted that, in order to simplify the following detailed description, this bending machine is described in its customary position of use in which, in particular, the bending axis (Z) is a vertical axis and the displacement axis (X) is a horizontal axis. Consequently, the terms vertical, horizontal, etc. refer to such a position.

This bending machine comprises, in the first place, a frame 1 having a horizontal upper face 1*a*, resting on the floor by a first rear base 2 and being prolonged by a front base 3 in the form of a cylindrical pedestal 4 extending as a prolongation of the frame 1.

This bending machine comprises a mandrel carriage 5 mounted so as to slide along rails such as 6 parallel to the longitudinal axis (X), arranged in the rear zone of said frame, said carriage being actuated by a motorized assembly of electric motor, pinions, belt, screw and nut, of which only one pinion 7 is shown in FIG. 1.

This carriage 5 carries a mandrel head 8 in which is secured the end of a mandrel bar 9, at the other end of which is mounted a mandrel 10.

Furthermore, for purposes of regulating the transverse position of the mandrel 10, a customary function for the bending radius of profiled sections, the mandrel head 8 is fixed to a support element 11 extending through a transverse space 12 produced in a vertical plate 13 which is integrated with the carriage 5, said support element 11 forming a nut carried by a transverse screw extending behind the vertical plate 13.

The bending machine likewise contains, in usual fashion, a ruler 15 carried by means of displacement of said ruler along a longitudinal axis parallel to the axis (X) and along a transverse horizontal axis (y) orthogonal to said axis (X). Moreover, this ruler 15 can also be equipped with a rocker element (not shown) for clamping the profiled section lodged in the latter, in order to allow said section to be pushed during the bending steps for the latter.

For this purpose, the ruler is integrated laterally on a longitudinal carriage 16 outfitted with a nut 17 cooperating with a screw 18 of longitudinal axis (x) driven in rotation by a motorized assembly of electric motor, pinions, belt, screw and nut, of which only one pinion 20 is shown in FIG. 1.

Moreover this longitudinal carriage is mounted to slide along rails such as 22 which are integrated on a second transverse carriage 21 designed to move on the frame 1 along a transverse axis (y) and driven, for this purpose, by a motorized assembly of electric motor 23, pinions 24, 26, belt 25, screw and nut.

The bending machine likewise comprises a bending unit 27 forming the bending head of the bending machine with the aforementioned ruler 15 and a wiper die element of classical type, not shown in the figures.

This bending unit 27 comprises a circular plate 28 integrated with a rotational toothed crown 29 having a vertical axis of rotation (z), driven in rotation by means of a pinion 30 mounted on the vertically arranged drive shaft of an electric motor 31.

This bending unit furthermore comprises a hollow vertical mast 32 integrated with the plate 28 and on which is integrated a transverse arm 33 consisting of a vertical plate.

The hollow mast 32 is closed, in the area of its upper end, by a circular interface plate 34 on which there extends a shaft 35 defining the bending axis (Z), for positioning of a bending former 36 through which an axial borehole 37 passes, designed to lodge said shaft.

This bending former 36, especially as shown in FIG. 6, consists of a cylindrical roller having a peripheral groove 38, and it has an indentation 39 of L-shaped section bounded by two perpendicular walls 39*a*, 39*b*.

This bending former 36 furthermore has a T-shaped vertical slot emerging in the area of the front face 39*b* of the indentation 39 orthogonal to the transverse axis (y).

Moreover, a vertical through slit 41 is also produced in the bending former 36, so as to emerge in the area of the aforesaid front face 39*b* of the indentation 39.

The hollow mast 32 also has an indentation 32*a*, the same as the interface plate 34, in order to ensure the vertical guiding of a stack of five clamping jaws 42-45, known as counter clamping jaws, each one having:

- a front face in which a cavity 42*c*-45*c* is produced for clamping a profiled section,
- two perpendicular rear faces such as 42*a*, 42*b*, (see FIG. 7) giving said counter clamping jaws a suitable shape to fit into the indentation 39 of the bending former 36 with the cavity 42*c*-45*c* extending as a continuation of the peripheral groove 38 of said bending former.

Moreover, a vertical slot 46 is produced in the rear face 42*b* of these counter clamping jaws 42-45 abutting against the face 39*b* of the indentation 39, corresponding to the T-shaped slot 40 of said indentation.

Furthermore, the counter clamping jaw 45 situated at the top of the stack constitutes a blank having a planar front face in which a rectilinear cavity 45*c* is disposed, also being pierced on either side of said cavity by indexing holes such as 47, for example, being four in number.

This blank 45 furthermore comprises a vertical through slit 48 emerging into the cavity 45*c*, designed to extend as a continuation of the slot 41 produced in the bending former 36.

For the movement of the stack of counter clamping jaws 42-45 in order to position one of these counter clamping jaws in the indentation 39 of the bending former 36, this stack rests against an end stop 49 connected to the bending former by a T-shaped ruler 50 so as to be inserted into the respective slots 40, 46 of said bending former and said counter clamping jaws, said ruler acting as a guide rail and being:

integrated with the rear face such as 42*b* of the counter clamping jaws 42-45 by means of fixation elements such as screws, mounted so as to slide inside the slot 40 of the bending former 36.

This movement is furthermore produced by a rack and pinion system having:

a rack 51 arranged vertically, at the upper end of which is integrated the end stop 49, mounted so as to slide in a slider 52 integrated with the mast 32, a pinion 53 driven by an electric motor 54.

The bending unit also has a stack of clamping jaws 55-58 having a front face in this there is produced a cavity 55*c*-58*c* for clamping a complementary profiled section of a cavity 42*c*-45*c* of one of the counter clamping jaws 42-45.

Opposite this front face, each clamping jaw 55-58 has furthermore a planar rear face such as 55*a*, in which there is produced a vertical slot 59.

The three upper jaws 55-57 of the stack are arranged side by side and integrated, in the area of their rear face 55*a*, with an interface block 60.

The fourth clamping jaw 58 located at the base of the stack constitutes a blank holder designed to cooperate with the blank 45 in order to clamp a profiled section and allow a cutting operation.

This blank holder 58 has a planar front face in which is produced a straight cavity 58*c* complementary to the cavity 45*c* of the blank 45, furthermore having on either side of said cavity indexing pins such as 61 adapted to fit into the indexing holes 47.

This blank holder 58 furthermore comprises a vertical through slit 62 emerging into the cavity 58*c*, produced in the same vertical transverse plane as the slit 48 made in the blank 45.

This blank holder 58 is furthermore connected by helical springs such as 65 to an interface block 63 with which a cutting blade 65 is integrated, designed to:

extend partly into the slit 62 of the blank holder 58 as shown in FIG. 8, without emerging into the cavity 58*c*, in the expanded state of the springs 64, extend into the respective slits 41, 48, 62 of the bending former 36, the blank 45 and the blank holder 62, as shown in FIG. 9, in the compressed state of the springs 64, in which position the piece of profiled section clamped in the cavities 45*c*, 58*c* is sliced and the chip is vacated to the outside of the bending former 36.

These clamping jaws 55-58 are associated with means of displacement designed to position them in:

a position retracted from the counter clamping jaws 42-45, allowing for changing of a profiled section, movements of this section between two bending steps, unloading of the section, etc., a position of mating of one of the clamping jaws 55-58 with the counter clamping jaw 42-45 positioned in the indentation 39 of the bending former 36, a supplemental cutting position ordered when the blank 45 is positioned in the indentation 39 of the bending former 36, after mating of said blank with the blank holder 58, in which the springs 64 are compressed.

For this purpose, these means of displacement comprise a first vertical carriage having a vertical plate 70 integrated on a frame 71 mounted so as to slide along vertical rails 72 carried by a second transverse carriage, formed by beams 73 on which said rails are assembled, said transverse carriage being mounted so as to slide along transverse rails 74 integrated on the front face of the frame 1.

Moreover, the movement of the vertical carriage 70, 71 is produced by a rack and pinion system having:

a rack 75 arranged vertically, at the upper end of which is integrated the frame 71, a pinion not shown, driven by an electric motor 76.

As for the transverse carriage 72,73, this is equipped with a nut 77 cooperating with a transverse screw 78 driven in rotation by a motorized assembly of electric motor 79, pinions 80, 81, belt, screw 78, and nut 77.

Moreover, the controls of the motors 76, 79 are advantageously correlated.

Furthermore, the plate 70 is extended by a lateral vertical wing 70*a* for purposes of fixation, on the vertical carriage 70, 71, of interface blocks 60, 63, having slots 60*b*, 63*b* for this purpose, in order to install keys.

It should be noted that the clamping jaws 55-58 and the interface blocks 60 are likewise equipped with opposite slots 59, 60*a* for purposes of integrating said clamping jaws with said interface blocks.

It should also be noted that the design of the clamping jaws 55-58 and the counter clamping jaws 42-45 and their means of mounting gives the latter a modular nature, allowing an assembly and disassembly of different models of these elements.

The functioning of the bending machine according to the invention for purposes of changing a counter clamping jaw and a clamping jaw during the bending of a pipe (T) is described below with reference to FIGS. 10*a* to 10*d*, starting from a position shown in FIG. 10*a* corresponding to the final stage of making a bend.

The first step involves bringing the stack of clamping blocks 55-58 into a position retracted by means of motors 76, 79 with correlated controls (FIG. 10*b*).

In parallel with this (FIG. 10*b*), a supplemental rotation of the clamping form 36 and the counter clamping jaws 42-45 along a predetermined angular path is ordered by actuation of the motor 51. This supplemental rotation has the purpose of positioning the bending former 36 and the counter clamping jaws 42-45 in an angular position relative to the pipe (T), in which said pipe can be easily cleared from engagement with the latter by a simple relative movement between said pipe and the assembly of bending former 36/counter clamping jaws 42-45.

It should be noted, however, that an identical result can be obtained either by equipping the bending machine with means of displacement of the pipe (T) in the two directions along a transverse axis (y), or by equipping this bending machine with means of displacement of the bending unit 27 in the two [directions] along a transverse axis (y).

Figure 10C:
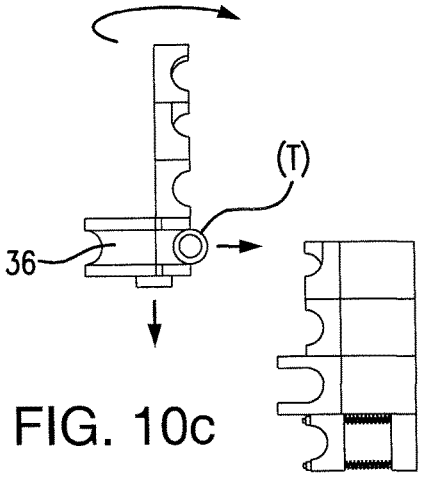

The next stage, shown in FIG. 10*c*, consists in moving the assembly of bending former 36/counter clamping jaws 42-45 by actuation of the motor 54, which movement is enabled as described above.

Once the counter jaw has been selected, being the counter jaw 43 in the example, and positioned in the indentation 39 of the bending former 36, the next stage consists in simultaneously, as shown in FIG. 10*d*:

ordering an inverse rotation, on the predetermined angular path, of the clamping form 36 and the counter clamping jaws 42-45, bringing the stack of clamping blocks 55-58 into a position of mating of the clamping jaw 56 with the counter clamping jaw 43.

The above described operations can also be implemented in order to obtain a position, shown in FIG. 10*e*, in which the blank 45 and the blank holder 58 are mated and indexed by the pins 61, clamping a pipe (T). Starting from this position, a supplemental movement of the transverse carriage 70, 71 results in compressing the springs 64, and drives a displacement of the cutting blade 65 which slices a piece of the pipe (T) and expulsion of the resulting chip.

It should be noted that these cutting operations are enabled thanks to the specific design of the bending machine according to the invention which in particular allows a driving, without the need for specific actuating or control means, the mating of the blank 45 and the blank holder 58 and the slicing operation.

The invention claimed is:

1. A device for bending a profiled section extending along a longitudinal axis, comprising:

at least one bending former oriented along a bending axis orthogonal to the longitudinal axis, having a peripheral groove terminating at an indentation in the bending former;

at least two counter clamping jaws stacked upon each other, each of the at least two counter clamping jaws comprising a counter clamping cavity for receiving the profiled section, and each of the at least two counter clamping jaws having a fitting portion configured to fit into the indentation of each bending former, the counter clamping cavity extending as a continuation of the peripheral groove of the bending former when the fitting portion is fit into the indentation;

a vertical displacement assembly of the at least two counter clamping jaws configured to move the at least two counter clamping jaws along an axis parallel to the bending axis to facilitate positioning of each of the at least two counter clamping jaws in the indentation of the bending former;

at least two clamping jaws stacked upon each other, the at least two clamping jaws comprising cavities which are complementary to the counter clamping cavities of the counter clamping jaws;

a relative displacement assembly configured to transition the at least one bending former, the at least two counter clamping jaws, and the at least two clamping jaws between (i) a closed position where the clamping cavity of one of the at least two clamping jaws is mated with the counter clamping cavity of one of the at least two counter clamping jaws that is positioned in the indentation of the at least one bending former, and (ii) an open position where the at least two counter clamping jaws are separated from the at least two clamping jaws;

a rotation assembly configured to simultaneously rotate the at least one bending former, the at least two counter clamping jaws, and the stack of clamping jaws about the bending axis; and a first guide extending in parallel with the bending axis, the first guide accommodating the at least two counter clamping jaws; and a transverse arm along which there extends a second guide accommodating the at least two clamping jaws, wherein the at least one bending former is integrated with an end of a mast centered on the bending axis, the mast being integrated on a plate mounted on the rotation assembly.

2. The bending device according to claim 1, wherein the relative displacement assembly comprises a first subassembly that is configured to move the at least two clamping jaws relative to the at least two counter clamping jaws.

3. The bending device according to claim 2, wherein the first subassembly comprises:

a transverse movement portion configured to move the at least two clamping jaws along a transverse axis that is orthogonal to the longitudinal axis and the bending axis; and a vertical movement portion that is configured to move the at least two clamping jaws along an axis parallel to the bending axis.

4. The bending device according to claim 3, wherein the transverse movement portion and the vertical movement portion are actuated by correlated-control motors comprising actuation of a vertical displacement correlated to a controlled actuation of a transverse motion.

5. The bending device according to claim 1, wherein a first clamping jaw of the at least two clamping jaws is positioned at an end of the at least two clamping jaws stacked upon each other, wherein a first counter clamping jaw of the at least two counter clamping jaws is positioned at an end of the at least two counter clamping jaws stacked upon each other, and wherein the first clamping jaw includes a blank holder that is designed to mate with a blank on the first counter clamping jaw, the blank holder having a transverse aperture extending into a cavity of the blank holder, a cutting element accommodated in the transverse aperture, and an elastic element associated with the cutting element, the blank holder designed to:

hold the cutting element in a retracted position retracted from the cavity of the blank holder when a force is not exerted on the elastic element, and enable, when a force is exerted on the elastic element in the mated position of the blank holder and the blank, the displacement of the cutting element into an active cutting position in which the cutting element extends into a volume bounded by the cavity of the blank holder and a cavity of the blank.

6. The bending device according to claim 2, wherein an elastic element extends between a blank holder and the relative displacement assembly; the transverse movement portion is designed to compress the elastic element when the blank holder is mated with the blank, whereby the elastic element is oriented to extend in a direction toward a component that holds the blank from the relative displacement assembly and components incorporated into the relative displacement assembly control the extension of the elastic element.

7. The bending device according to claim 2, wherein a first clamping jaw of the at least two clamping jaws is positioned at and end of the at least two clamping jaws stacked upon each other, wherein a first counter clamping jaw of the at least two counter clamping jaws is positioned at an end of the at least two counter clamping jaws stacked upon each other, and wherein the first clamping jaw includes a blank holder that is designed to mate with a blank on the first counter clamping jaw, the blank holder having a transverse aperture extending into a cavity of the blank holder, a cutting element accommodated in the transverse aperture, and an elastic element associated with the cutting element, the blank holder designed to:

hold the cutting element in a retracted position retracted from the cavity of the blank holder when a force is not exerted on the elastic element, and enable, when a force is exerted on the elastic element in the mated position of the blank holder and the blank, the displacement of the cutting element into an active cutting position in which the cutting element extends into a volume bounded by the cavity of the blank holder and a cavity of the blank.

8. The bending device according to claim 3, wherein a first clamping jaw of the at least two clamping jaws is positioned at an end of the at least two clamping jaws stacked upon each other, wherein a first counter clamping jaw of the at least two counter clamping jaws is positioned at an end of the at least two counter clamping jaws stacked upon each other, and wherein the first clamping jaw includes a blank holder that is designed to mate with a blank on the first counter clamping jaw, the blank holder having a transverse aperture extending into a cavity of the blank holder, a cutting element accommodated in the transverse aperture, and an elastic element associated with the cutting element, the blank holder designed to:

hold the cutting element in a retracted position retracted from the cavity of the blank holder when a force is not exerted on the elastic element, and enable, when a force is exerted on the elastic element in the mated position of the blank holder and the blank, the displacement of the cutting element into an active cutting position in which the cutting element extends into a volume bounded by the cavity of the blank holder and a cavity of the blank.

9. The bending device according to claim 3, wherein an elastic element extends between a blank holder and the relative displacement assembly, and the transverse movement portion is designed to compress the elastic element when the blank holder is mated with the blank.

10. The bending device according to claim 4, wherein an elastic element extends between a blank holder and the relative displacement assembly, and the transverse movement portion is designed to compress the elastic element when the blank holder is mated with the blank.

11. The bending device according to claim 5, wherein the elastic element extends between the blank holder and the relative displacement assembly, and the transverse movement portion is designed to compress the elastic element when the blank holder is mated with the blank.

12. The bending device according to claim 2, the bending device further comprising:

a first guide extending in parallel with the bending axis, the first guide accommodating the at least two counter clamping jaws; and a transverse arm along which there extends a second guide accommodating the at least two clamping jaws, wherein the at least one bending former is integrated with an end of a mast centered on the bending axis, the mast being integrated on a plate mounted on the rotation assembly.

13. The bending device according to claim 3, the bending device further comprising:

a first guide extending in parallel with the bending axis, the first guide accommodating the at least two counter clamping jaws; and a transverse arm along which there extends a second guide accommodating the at least two clamping jaws, wherein the at least one bending former is integrated with an end of a mast centered on the bending axis, the mast being integrated on a plate mounted on the rotation assembly.

14. The bending device according to claim 5, the bending device further comprising:

a first guide extending in parallel with the bending axis, the first guide accommodating the at least two counter clamping jaws; and a transverse arm along which there extends a second guide accommodating the at least two clamping jaws, wherein the at least one bending former is integrated with an end of a mast centered on the bending axis, the mast being integrated on a plate mounted on the rotation assembly.

15. A device for bending a profiled section extending along a longitudinal axis, comprising:

at least one bending former having a peripheral groove radially disposed about a bending axis orthogonal to the longitudinal axis, the peripheral groove terminating at a vertical groove that extends along a first direction parallel to the bending axis;

a first stack of clamping jaws including at least two counter clamping jaws vertically stacked upon each other along a second direction parallel to the bending axis, each of the at least two counter clamping jaws comprising a counter clamping cavity for receiving the profiled section, and each of the at least two counter clamping jaws having a fitting portion configured to fit into the vertical groove, the counter clamping cavity extending as a continuation of the peripheral groove of the bending former when the fitting portion is fit into the vertical groove;

a second stack of clamping jaws including at least two clamping jaws stacked upon each other in the first direction, the at least two clamping jaws comprising clamping cavities which are complementary to the counter clamping cavities of the counter clamping jaws;

a first vertical displacement assembly configured to move the first stack of clamping jaws back and forth along the second direction to position one of the at least two clamping jaws of the first stack along the vertical groove;

a second vertical displacement assembly configured to move the second stack of clamping jaws back and forth along the first direction to position the clamping cavity of one of the at least two clamping jaws of the second stack to oppose the counter clamping cavity of the one of the at least two clamping jaws of the first stack positioned along the vertical groove; and a rotation assembly configured to simultaneously rotate the at least one bending former, the first stack of clamping jaws, and the second stack of clamping jaws about the bending axis; and a first guide extending in parallel with the bending axis, the first guide accommodating the at least two counter clamping jaws; and a transverse arm along which there extends a second guide accommodating the at least two clamping jaws, wherein the at least one bending former is integrated with an end of a mast centered on the bending axis, the mast being integrated on a plate mounted on the rotation assembly.

* * * * *